US006956494B2

(12) United States Patent
Tichborne et al.

(10) Patent No.: US 6,956,494 B2
(45) Date of Patent: Oct. 18, 2005

(54) SIGNAL LAMPS AND APPARATUS

(75) Inventors: Frank George Tichborne, North East Somerset (GB); Colin Burton, Chippenham (GB)

(73) Assignee: Westinghouse Brake and Signal Holdings Limited, Chippenham (GB)

( * ) Notice: Subject to any disclaimer, the term of this patent is extended or adjusted under 35 U.S.C. 154(b) by 0 days.

(21) Appl. No.: 10/316,612

(22) Filed: Dec. 10, 2002

(65) Prior Publication Data

US 2003/0137427 A1 Jul. 24, 2003

(30) Foreign Application Priority Data

Dec. 11, 2001 (GB) ..... 0129610

(51) Int. Cl.[7] ..... G08B 5/22

(52) U.S. Cl. ..... 340/815.45; 340/332; 340/458; 340/931

(58) Field of Search ..... 340/931, 458, 340/944, 925, 642, 331, 332, 333, 815.45; 246/1 C; 315/129, 160; 362/478, 800

(56) References Cited

U.S. PATENT DOCUMENTS

| | | | | |
|---|---|---|---|---|
| 4,271,408 A | | 6/1981 | Teshima et al. | |
| 4,298,869 A | | 11/1981 | Okuno | 340/332 |
| 4,654,629 A | * | 3/1987 | Bezos et al. | 246/473.3 |
| 5,301,090 A | * | 4/1994 | Hed | 362/558 |
| 5,661,645 A | * | 8/1997 | Hochstein | 363/89 |
| 5,663,719 A | * | 9/1997 | Deese et al. | 340/912 |
| 5,767,783 A | | 6/1998 | Dernier | |
| 6,078,148 A | * | 6/2000 | Hochstein | 315/291 |
| 6,167,648 B1 | * | 1/2001 | Dimmick | 40/564 |
| 6,249,088 B1 | | 6/2001 | Chang | 315/241 S |
| 6,608,332 B2 | * | 8/2003 | Shimizu et al. | 257/98 |
| 6,667,623 B2 | * | 12/2003 | Bourgault et al. | 324/414 |
| 6,693,556 B1 | * | 2/2004 | Jones et al. | 340/907 |

FOREIGN PATENT DOCUMENTS

| | | |
|---|---|---|
| DE | 197 49 333 A1 | 3/1999 |
| DE | 19749333 A1 | 3/1999 |
| GB | 2 131 589 A | 6/1984 |
| WO | WO 99/20085 | 4/1999 |
| WO | WO 01/39553 A1 | 5/2001 |

OTHER PUBLICATIONS

European Search Report dated May 13, 2002 from priority U.K. Application No. GB 0129610.2 filed Dec. 11, 2001.
European Search Report dated Oct. 18, 2002 from priority U.K. Application No. GB 0129610.2 filed Dec. 11, 2001.

* cited by examiner

*Primary Examiner*—Brent A. Swarthout
(74) *Attorney, Agent, or Firm*—Christie Parker & Hale LLP

(57) ABSTRACT

An LED signal lamp comprises at least two separate LED arrays which have separate power feeds and wherein the LEDs of the arrays are positioned with respect to each other such that when lit they provide a composite light signal output and such that when the LEDs of only one of the two arrays are lit they provide a light signal with a visible distinctive pattern. A distinctive pattern is revealed, either lit or dark. Typically this pattern may be formed as a letter such as "X" or "F" or may be formed as a striped effect, for example.

An LED signal apparatus comprises input signal power supply terminals 7,8 for the apparatus; a series connection of switch means S1 to S4 and a ballast load 6 connected across the supply terminals 7,8; an LED signal lamp 1,2 connected to the terminals to be supplied with current therefrom; and switch operating means D1 to D4, in the supply path to the LED lamp, for controlling the state of the switch means S1 to S4 in the series connection, whereby total failure or substantially total failure of the current to the LED signal lamp results in said switch operating means D1 to D4 causing said switch means to open to disconnect the ballast load 6 from power from the supply terminals 7,8.

14 Claims, 1 Drawing Sheet

SIGNAL LAMPS AND APPARATUS

CROSS-REFERENCE TO RELATED APPLICATION(S)

This application claims priority of United Kingdom Patent Application No. 0129610.2, filed Dec. 11, 2001.

SUMMARY OF THE INVENTION

The present invention relates to signal lamps and apparatus and particularly, although not exclusively, to railway signal lamps and apparatus and particularly to lamps and apparatus utilising Light Emitting Diodes (LEDs) as light emitters instead of normal filament bulbs.

An LED signal consist of a multiplicity of LEDs which collectively produce a monochromatic light emitting from a viewing aperture equivalent in size to a conventional filament lamp light signal aperture. Since the source is not a single filament as in a bulb, the LEDs are arranged in a pattern of points over the aperture. Use of LEDs has the advantage over single filament bulbs that, whilst individual LEDs may fail, this does not cause complete failure of the signal lamp as occurs with a bulb single filament failure. A failure in the control supply to the LEDs would, however, cause a complete failure.

According to one aspect of the present invention an LED signal lamp comprises at least two separate LED arrays which have separate power feeds and wherein the LEDs of the arrays are positioned with respect to each other such that when lit they provide a composite light signal output and such that when the LEDs of only one of the two arrays are lit they provide a light signal with a visible distinctive pattern.

According to one embodiment of the invention an LED signal lamp is formed with two LED arrays, each forming half of the signal display and each having separate control electronics supplied from the signalling supply. Hence if either half fails, either in the electronics or some of the LEDs such that current ceases to flow in the array, then half of the LEDs extinguish. The LEDs of the two arrays are arranged such that, on extinguishing of one array with the remaining half of the LEDs formed by the other array remaining alight, a distinctive pattern is revealed, either lit or dark. Typically this pattern may be formed as a letter such as "X" or "F" or may be formed as a striped effect, for example. A viewer (typically a train driver) of a signal in this state will interpret the displayed signal as a valid signal, but a signal that has to be reported as defective in appearance, resulting in a maintenance alert where the defective aspect of the signal can be replaced.

An LED signal lamp typically takes less power (6 Watts) than an equivalent filament lamp type signal (30 Watts). Hence when replacing Filament lamp signals with LED signal lamps in the existing railway signalling, the LED signal current needs to be ballasted to equate with that of a Filament lamp when lit, to enable the existing signal interlocking circuitry to detect a dark signal failure. The ballasting is effected utilising a ballast resistor in parallel with the LED signal across the signal supply. With the typical levels of power consumption mentioned above, this ballast resistor will take approximately 80% of the supplied current.

In the existing railway signalling network, it is substantial cessation of supply current during a signal operation phase that indicates signal failure. It is, therefore, imperative that some form of interlock be applied to ensure that, if LED current stops, the ballast load is also disconnected from the supply. This has typically been performed by a fuse blow circuit. However because of the active nature of this circuit, it is inherently less reliable than the dropped relay version as applied to a filament lamp which is inherently fail safe.

According to a second aspect of the present invention, an LED signal apparatus comprises input signal power supply terminals for the apparatus; a series connection of switch means and a ballast load connected across the supply terminals; an LED signal lamp connected to the terminals to be supplied with current therefrom; and switch operating means, in the supply path to the LED lamp, for controlling the state of the switch means in the series connection, whereby, during operation of the apparatus, total failure or substantially total failure of the current to the LED signal lamp results in said switch operating means causing said switch means to open to disconnect the ballast load from power from the supply terminals.

Advantageously, the switch operating means may comprise an optocoupled diode for controlling an electronic switch such that, if electric current flows through the diode, the electronic switch closes and vice versa.

In preferred embodiments of the invention, the LED signal lamp comprises at least two separate LED arrays arranged jointly to provide a signal light output for the lamp and wherein each of said arrays has an individual switch control means in its supply path and said ballast load is connected to said supply terminals through a plurality of switch means each controlled by a respective one of the switch control means and the arrangement is such that provided current flows to one of said arrays, the corresponding switch control means controls its respective switch means to permit current to flow through the ballast load. Preferably, in such an arrangement, detection means are provided to detect that not all the switch means are permitting flow of current to the ballast load and to provide a non-urgent alarm signal to that effect. Such an alarm signal would normally indicate failure of current flow through the array associated with the corresponding switch control means. The detection means may comprise a relay with its relay coil connected between switch means controlled points, in the supply to the ballast load, that are at substantially the same voltage during closure of all switch means but which are at different voltages, in the event of opening of only one of the switch means, such that relay operating current flows through the relay coil.

Preferably, a pair of switch control means are connected in parallel in the supply to an array such that supply of current to the array is not interrupted solely as the result of failure of a single switch control means. Additionally there may be a pair of switch means each associated with a respective one of the pair of switch control means.

BRIEF DESCRIPTION OF THE DRAWINGS

For a better understanding of the present invention, reference will now be made to the accompanying drawings, in which, solely by way of example.

In both figures, the same references have been used for the same or corresponding elements.

DETAILED DESCRIPTION OF THE DRAWINGS

Figure 1:
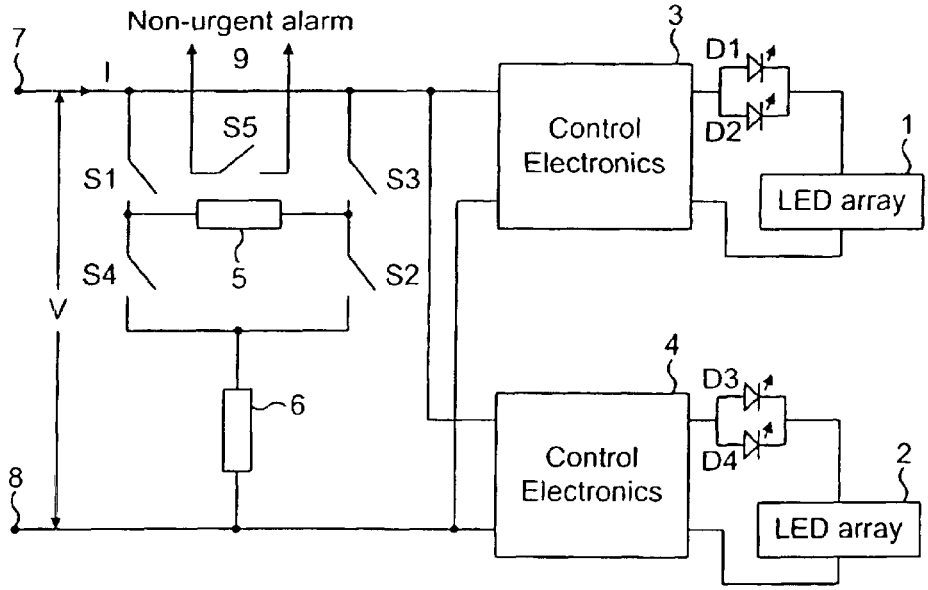
FIG. 1, shows diagrammatically the circuit of one embodiment of railway signal lamp apparatus in accordance with the second aspect of the invention.

The circuit arrangement of FIG. 1 has two LED arrays 1 and 2, housed together in the same lamp (not shown) and designed to provide together the output signal light for the lamp. LED array 1 is connected to an array control electronics unit 3 through two supply lines, in one of which there are two optocoupled diodes D1 and D2. Similarly, LED array 2 is coupled to control electronics unit 4 through two separate supply lines, of which one includes parallel connected optocoupled diodes D3 and D4.

Two signal power terminals for the apparatus are referenced 7 and 8 and the signal supply voltage and current are shown as V and I respectively. These supply terminals are connected directly, to supply signal power thereto, to the control electronics units 3 and 4. A ballast load 6 is connected across terminals 7 and 8, one end being connected directly to terminal 8 with the other end being connected to terminal 7 through two pairs of switches S1, S4 and S3, S2. The switches of each pair of switches are connected in series between terminal 7 and said other end of the ballast load 6. The junction between the switches of each pair of switches are connected via the coil of a relay 5. Switch contacts S5 of relay 5 are coupled to a "non-urgent alarm" output 9. The switching state of each of the switches S1 to S4 is controlled by the correspondingly numbered optocoupled diodes D1 to D4.

As indicated, the LED signal lamp is formed with two LED arrays 1 and 2, each forming half of the signal display and each having separate control electronics supplied from the signalling supply. Hence, if either half fails, either in the electronics or in the LED array such that current ceases to flow in the array, then half of the LEDs extinguish. The LEDs of the two arrays are arranged such that, on extinguishing of one array with the remaining half of the LEDs formed by the other array remaining alight, a distinctive pattern is revealed, either lit or dark. Typically this pattern may be formed as a letter such as "X" or "F" or may be formed as a striped effect, for example. As a result, a viewer (typically a train driver) of a signal in this state will interpret the displayed signal as a valid signal but one that has to be reported as defective in appearance, resulting in a non-urgent maintenance alert where the defective aspect of the signal can be replaced.

In the FIG. 1 circuit, when power is applied to the input terminals 7,8, both control electronics units 3 and 4 provide independent power to LED arrays 1 and 2 via the diodes D1 and D2 (for LED array-1) and D3 and D4 (for LED array-2). These four optocoupled diodes, control switches SI, S2, S3 and S4 respectively such that if current flows through DI electronic switch S1 closes. Normally, on application of signal power, current flows through all 4 diodes D1–D4 and hence S1–S4 are closed. This results in the ballast load 6 being in circuit, connected across the power supply terminals 7 and 8, and the combined effect of the ballast load 6 and the LED current, via the 2 sets of control electronics are arranged to be equivalent in load to that of a normal filament signal lamp. Hence, the normal hot filament proving circuit, in the standard existing control signal interlocking arrangement, will detect what it believes to be a normally operating filament signal lamp and react correctly. In this normal condition the voltage across the coil of the non-urgent alarm relay 5 is effectively zero and hence the contact S5 (which is normally closed) remains closed.

In the case where current stops flowing through one or other LED array (causing it not to be lit), then two switches will open. For example if LED array 1 fails, then S1 and S2 open and current then flows via S3, the relay coil and S4 to the ballast load 6. Similarly if LED array 2 fails then S3 and S4 open and current then flows via S1, the relay coil 5 and S2 to the ballast load 6. Hence in either of these partial failure cases, the non-urgent alarm output 9 is signalled by the opening of contact S5. However the signal load current, although reduced slightly, is still sufficient to indicate to the interlocking control that the lamp is operational. This is equivalent to the first filament failure alarm in a conventional signal.

In the very rare event that current stops being supplied to both LED arrays, then all 4 switches SI to S4 open and the ballast load is removed from circuit. This effect, plus the loss of current to both arrays results in a loss of load current from the interlocking control arrangement sufficiently to guarantee the asserting of an Urgent Alarm in the interlocking control, which sets safe operation of the signalling. In this case the non-urgent alarm is not set but that is not a problem since it is overridden by the Urgent Alarm. The operation of the Urgent Alarm circuit is thus fault tolerant, and hence very reliable. Combined with the duplex operation of the LED arrays this arrangement may enable the meeting of a UK specified railway signalling reliability target of <1 undetected dark signal lamp in $10^{11}$ hours.

Figure 2:
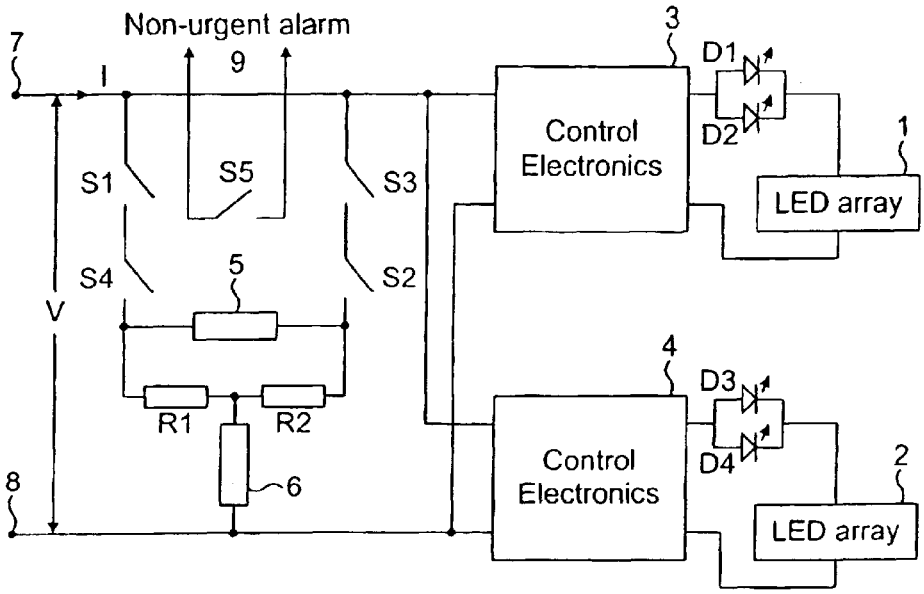
FIG. 2, shows diagrammatically the circuit of a second embodiment of railway signal lamp apparatus in accordance with the second aspect of the invention.

The arrangement of FIG. 2 differs from that of FIG. 1 solely in the arrangement of the switches S1 to S4 and by the addition of two resistances R1 and R2. In this arrangement switches S1 and S2 form one pair and S3 and S4 form another. Switch pair S1,S2 is connected in series with resistance R1 between supply line 7 and said other end of the ballast load 6. Similarly switch means pair S3,S4 is connected in series with resistance R2 between supply line 7 and said other end of ballast load 6.

This circuit arrangement provides a reliable switch S1 in series with S2, respectively operated optically by DI and D2 passing current. In the case of LED array 1 stopping taking current (either by the LED array 1 or the control electronics unit 3 failing), a voltage is generated across R2 sufficient to cause activation of the non-urgent alarm relay 5 with current flowing through the coil via resistance RI. Similarly, if LED array 2 stops taking current then S3 and S4 are opened and a voltage is generated across RI sufficient to activate the non-urgent alarm relay 5 via R2.

The circuit arrangement of FIG. 2 has the advantage that if any of the four switches S1 to S4 fails short-circuit, the circuit continues operation correctly, whereas if any of the four switches fails open-circuit, it activates the non-urgent alarm. In both cases, the signal continues to operate correctly with the ballast load connected. In all other respects the operation of the second variant is the same as the first In combination with the distinctively patterned LED arrays, which will alert drivers to a partially failed lamp for these to be independently reported, reliability is further enhanced.

What is claimed is:

1. An LED signal lamp comprising at least two separate LED arrays which are connected in parallel such that they have separate power feeds and circuitry connected with the LED arrays and wherein the LEDs of the arrays are positioned with respect to each other such that when lit they provide a composite light signal output and such that should the current through either array fail, the LEDs of the other array may still light, and when the LEDs of only one of the two arrays are lit the lamp provides a signal with a visible distinctive pattern to provide a first indication of a failure of an array, said circuitry providing a second indication of said failure.

2. An LED signal lamp according to claim 1 wherein the distinctive pattern is revealed, either lit or dark.

3. An LED signal lamp according to claim 2 wherein the pattern is formed as an alphabetic letter or as a striped effect.

4. An LED signal apparatus comprising:

input signal power supply terminals for the apparatus;

a series connection of switch means and a ballast load connected across the supply terminals;

an LED signal lamp connected to the terminals to be supplied with current therefrom; and switch operating means, in the supply path to the LED lamp, for controlling the state of the switch means in the series connection, whereby, during operation total failure or substantially total failure of the current to the LED signal lamp results in said switch operating means causing said switch means to open to disconnect the ballast load from power from the supply terminals.

5. An LED signal apparatus comprising:

input signal power supply terminals for the apparatus;

a series connection of switch means and a ballast load connected across the supply terminals;

an LED signal lamp connected to the terminals to be supplied with current therefrom; and switch operating means, in the supply path to the LED lamp, for controlling the state of the switch means in the series connection, whereby, during operation total failure or substantially total failure of the current to the LED signal lamp results in said switch operating means causing said switch means to open to disconnect the ballast load from power from the supply terminals, wherein the switch operating means comprises an opto-coupled diode for controlling an electronic switch such that, if electric current flows through the diode, the electronic switch closes and vice versa.

6. An LED signal comprising:

input signal power supply terminals for the apparatus;

a series connection of switch means and a ballast load connected across the supply terminals;

an LED signal lamp connected to the terminals to be supplied with current therefrom; and switch operating means, in the supply path to the LED lamp, for controlling the state of the switch means in the series connection, whereby, during operation total failure or substantially total failure of the current to the LED signal lamp results in said switch operating means causing said switch means to open to disconnect the ballast load from power from the supply terminals, wherein the LED signal lamp comprises at least two separate LED arrays arranged jointly to provide a signal light output for the lamp and wherein each of said arrays has an individual switch control means in its supply path and said ballast load is connected to said supply terminals through a plurality of switch means each controlled by a respective one of the switch control means and the arrangement is such that, during operation, provided current flows to one of said arrays, the corresponding switch control means controls its respective switch means to permit current to flow through the ballast load.

7. An LED signal apparatus according to claim 6, wherein detection means are provided to detect if any switch means is not permitting flow of current to the ballast load and, if this is the case, to provide a non-urgent alarm signal to that effect.

8. An LED signal apparatus according to claim 7, wherein the detection means comprises a relay with its relay coil connected between switch means controlled points, in the supply to the ballast load, that during operation are at substantially the same voltage during closure of all switch means but which are at different voltages in the event of opening of only one of the switch means, whereby relay operating current flows through the relay coil.

9. An LED signal apparatus according to claim 6, wherein, for each array, a pair of switch control means in parallel is connected in the supply to the array, such that, during operation, supply of current to the array is not interrupted solely as the result of failure of a single switch control means.

10. An LED signal apparatus according to claim 9, wherein there is a pair of switch means for each array, each of which switch means is associated with a respective one of the pair of switch control means.

11. An LED signal lamp comprising at least two separate LED arrays which have separate power feeds and a switchable routing arrangement such that current may flow along different routes through the routing arrangement in dependence of a switching state of the routing arrangement, and wherein the LEDs of the arrays are positioned with respect to each other such that when lit they provide a composite light signal output and such that should the current through either array fail, the LEDs of the other array may still light, and when the LEDs of only one of the two arrays are lit the lamp provides a signal with a visible distinctive pattern providing a first indication of the failure of an array and the switchable routing arrangement is switched to provide a second indication of the failure of said array.

12. An LED signal lamp according to claim 11, wherein the switchable routing arrangement comprises a plurality of switches.

13. An LED signal lamp according to claim 12, wherein the LEDs of only one of the two arrays are lit, the routing arrangement is switched to enable current to flow through a particular route, thus activating the alarm.

14. An LED signal lamp according to claim 13, wherein the switches are controlled by respective switch operating means responsive to the flow of current though an LED array.

* * * * *